US007490365B2

(12) United States Patent
Matsumoto et al.

(10) Patent No.: US 7,490,365 B2
(45) Date of Patent: Feb. 17, 2009

(54) SWIMMING GOGGLES

(75) Inventors: Katsumi Matsumoto, Higashiosaka (JP); Katsuya Takeshi, Higashiosaka (JP); Hirofumi Tominaga, Higashiosaka (JP)

(73) Assignee: Yamamoto Kogaku Co., Ltd., Osaka (JP)

( * ) Notice: Subject to any disclaimer, the term of this patent is extended or adjusted under 35 U.S.C. 154(b) by 45 days.

(21) Appl. No.: 10/526,001

(22) PCT Filed: Aug. 25, 2003

(86) PCT No.: PCT/JP03/10712

§ 371 (c)(1),
(2), (4) Date: Mar. 16, 2005

(87) PCT Pub. No.: WO2004/020046

PCT Pub. Date: Mar. 11, 2004

(65) Prior Publication Data

US 2005/0241051 A1 Nov. 3, 2005

(30) Foreign Application Priority Data

Aug. 27, 2002 (JP) ..... 2002-247766

(51) Int. Cl.
*A61F 9/02* (2006.01)

(52) U.S. Cl. ..... 2/448; 351/43

(58) Field of Classification Search ..... 242/426, 242/428, 421, 430, 452, 448, 9; 128/858; 24/199; 351/43, 122, 123
See application file for complete search history.

(56) References Cited

U.S. PATENT DOCUMENTS

| | | | | |
|---|---|---|---|---|
| 4,264,987 | A * | 5/1981 | Runckel | 2/428 |
| 5,313,671 | A | 5/1994 | Flory | |
| 5,515,551 | A | 5/1996 | Yashiro | |
| 5,611,644 | A * | 3/1997 | Lutz | 405/186 |
| 5,706,526 | A * | 1/1998 | Huang | 2/428 |
| 5,708,491 | A * | 1/1998 | Onodera et al. | 351/122 |
| 5,727,259 | A | 3/1998 | Kawamata | |
| 5,896,589 | A | 4/1999 | Chou | |
| 6,092,243 | A * | 7/2000 | Wu et al. | 2/441 |
| 6,247,811 | B1 * | 6/2001 | Rhoades et al. | 351/156 |
| 6,349,421 | B2 * | 2/2002 | Fukasawa et al. | 2/428 |

(Continued)

FOREIGN PATENT DOCUMENTS

JP 6-42694 11/1994

(Continued)

*Primary Examiner*—Katherine Moran
(74) *Attorney, Agent, or Firm*—William L. Androlia; H. Henry Koda

(57) ABSTRACT

Swimming goggles, wherein belts are fitted to an eye protective eye cup portion, a mounting/dismounting mechanism for mounting and dismounting the goggles on and from a head part is fitted to the belts, whereby since the mounting/dismounting mechanism for mounting and dismounting the goggles on and from the head part is fitted to the belt fitted to the eye cup part, a user can mount and dismount the goggles on and from the head part by merely slightly pulling the belt to connect and disconnect the mounting/dismounting mechanism, and must not extend the belt by pulling to such a length as to provide an allowance for installation on the head, and the swimming goggle making it hard for hairs to be disturbed more than before when installed on the head part can be provided.

13 Claims, 10 Drawing Sheets

U.S. PATENT DOCUMENTS

| | | | | |
|---|---|---|---|---|
| 6,460,196 | B2 * | 10/2002 | Tsubooka et al. | 2/428 |
| 6,845,521 | B2 * | 1/2005 | Takeshi et al. | 2/452 |
| 6,865,753 | B2 * | 3/2005 | Nishida | 2/426 |
| 2001/0029623 | A1 | 10/2001 | Tsubooka | |

FOREIGN PATENT DOCUMENTS

| | | |
|---|---|---|
| JP | 3009948 | 4/1995 |

* cited by examiner

SWIMMING GOGGLES

FIELD OF THE INVENTION

This invention relates to a pair of swimming goggles for use in swimming.

DESCRIPTION OF THE RELATED ART

Conventionally, there has been a pair of swimming goggles used to protect eyes of a user in swimming.

As shown in FIG. 9, a pair of conventional swimming goggles includes an eye cup portion 21 for protecting eyes of a user and a belt 22 connected to the eye cup portion 21. When a user puts the swimming goggles on and off his/her head, the belt 22 has to be pulled and extended to such a length as to provide enough space for his/her head.

However, the pair of conventional swimming goggles sometimes causes such a problem that when a user tries to put the swimming goggles on his/her head with pulling the belt 22, the user's hair is tousled by being pulled with the belt 22. Especially for women with long hair, the belt 22 is much more likely to get stuck with their bundled hair. If the user is wearing a swimming cap, the swimming cap is likely to be displaced or removed from his/her head.

SUMMARY OF THE INVENTION

It is, therefore, an object of the present invention to provide a pair of swimming goggles which can be put on the head of a user with less tousling his/her hair compared with the conventional swimming goggles.

In order to solve the above-mentioned problems, the present invention takes the following technical means.

1. A pair of swimming goggles according to the present invention includes an eye cup portion for protecting eyes of a user, a belt which is connected to the eye cup portion and a connecting and disconnecting mechanism which is provided on the belt, and the connecting/disconnecting mechanism is used when the user puts the swimming goggles on and off his/her head.

In this swimming goggles, since the belt connected to the eye cup portion is provided with the connecting/disconnecting mechanism which is used when the user puts the swimming goggles on and off his/her head, the user can put the swimming goggles on and off the head by merely slightly pulling the belt to connect and disconnect the connecting/disconnecting mechanism, and the user does not have to pull the belt to extend it to such a length as to provide enough space for his/her head.

As the connecting/disconnecting mechanism, a mechanism of a one-touch-type, such as a buckle-type and a hook-type, can be employed. The entire length of the belt can be pre-determined by adjusting a length of the belt between the connecting/disconnecting mechanism and the eye cup portion The belt may be connected to the eye cup portion by putting the belt through a hole provided on the eye cup portion and then folding the belt back (the belt is fixed by friction between the eye cup portion and the belt). Alternatively, the belt may be connected to the eye cup portion by using a clasp.

2. The belt may be made to be wider around a back portion which fits to the user's occipital region and narrower around side portions which fit to the user's temporal region.

Because of this structure, the wide back portion of the belt can provide better stability, while the narrow side portions can stretch well. Double-type, single-type and twin-type belts used for swimming goggles belts, made from single material, have different cross-sectional areas according to their designs and so different stretching rates and strength from each other, but they respectively have a constant width. Thus, the stretching rates and the strength per unit area between the back portion and the side portions do not vary but are constant in general.

3. The belt may have a hard portion and a soft portion, and each connected area of the belt with the eye cup portion may be formed with the hard portion.

It is common to use material with elasticity (for example, elastic thermoset rubber or thermoplastic elastomer) for a belt for swimming goggles in order to improve fitting comfortability and the stability of the belt. However, if the material with elasticity is used for the connected areas of the belt with the eye cup portion, the elasticity causes a problem as the belt tends to come off the eye cup portion easily while the swimming goggles is in use. Therefore, there has been a demand for a pair of swimming goggles (and a belt for swung goggles) which has a reliable connection between the belt and the eye cup portion which is not easily disconnected.

Since the belt of the present invention has the above-mentioned structure, wherein the connected areas of the belt with the eye cup portion are made from hard material to be the hard portions, the belt can be firmly connected to the eye cup portion not to be easily released therefrom. On the other hand, the soft portion of the belt can fit to a user's head because of its elasticity.

4. The eye cup portion of the present invention may be provided with either projections or holes on both sides and the belt of the present invention may be provided with either holes or projections corresponding to the projections or the holes of the eye cup portion. The belt and the eye cup portion can be connected together by inserting the projections or the holes of the eye cup portion into the corresponding holes or projections of the belt.

The belt and the eye cup portion of the conventional swimming goggles are connected together by folding back the belt which is connected to the eye cup portion directly or through additional parts. However, there is a problem that this structure increases resistance against the water flow since there is a difference in level between the belt and the eye cup portion and the folded end portions of the belt flap around a user's temporal region. There is another problem that this structure makes the appearance unattractive. Therefore, there has been a demand for a pair of swimming goggles in which there is no difference in level between the belt and the eye cup portion, and there is no need that the belt has to be folded back.

Accordingly, the pair of swimming goggles of this present invention has the above-mentioned structure in order to have such advantages as there is no difference in level between the belt, and the belt does not have to be folded back Since there is no difference in level between the belt and the eye cup portion and the folded end portions of the belt do not flap around a user's temporal region, the resistance against the water flow can be decreased By omitting the conventionally used additional parts, the number of parts in total can be decreased.

5. The eye cup portion of the present invention may be provided with projections on its both sides, and the hard portion of the belt may be provided with holes corresponding to the projections. The belt can be connected to the eye cup portion by inserting the projections of the eye cup portion into the holes of the belt.

Because of this structure, the pair of swimming goggles of the present invention can have such advantages as high strength and superior durability. In case that hard material is used for the side areas of the eye cup portion where the projections or the holes are provided, the eye cup portion can be firmly connected with the hard portion of the belt.

6. A belt for a pair of swimming goggles according to the present invention is connected to an eye cup portion for protecting eyes of a user and the belt is provided with a connecting/disconnecting mechanism for putting the swimming goggles on and off a head of the user.

Since this belt, which is connected to the eye cup portion, is provided with the connecting/disconnecting mechanism which is used when a user puts the swimming goggles on and off his/her head, the user can put the swimming goggles on and off the head by merely slightly pulling the belt to connect and disconnect the connecting/disconnecting mechanism, and the user does not have to pull the belt to extend it to such a length as to provide enough space for his/her head.

DESCRIPTION OF THE PREFERRED EMBODIMENTS

Figure 1:
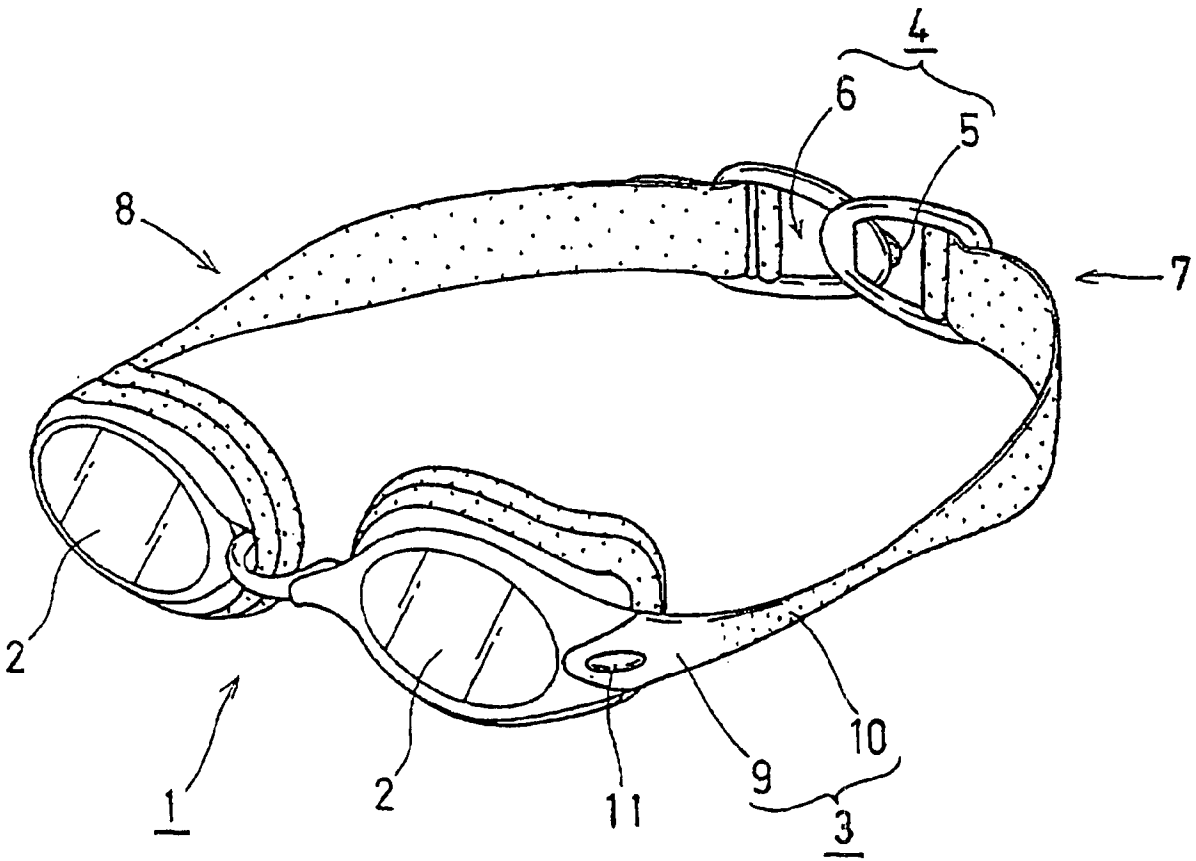
FIG. 1 is an entire perspective view of the swimming goggles of an embodiment according to the present invention.

Hereinafter, preferred embodiments of this invention are described referring to the drawings.

As shown in FIGS. 1 to 8, a pair of swimming goggles according to this embodiment has an eye cup portion 1 (which has left and right lenses 2) for protecting eyes of a user and a belt 3 which is connected to the both sides of the eye cup portion 1, and the belt 3 is provided with a connecting/disconnecting mechanism 4 which is used when the user puts the swimming goggles on and off his/her head.

As the connecting/disconnecting mechanism 4, a mechanism of a one-touch-type, such as a hook-type (see FIGS. 1 to 5) and a buckle-type (see FIGS. 6 and 7), can be employed.

As shown in FIGS. 1 to 5, the hook-type connecting/disconnecting mechanism 4 has a hook-shaped projection 5 and an engaging opening 6, and the mechanism 4 is made big in total size. In case of such a big-sized connecting/disconnecting mechanism 4, a user can connect and disconnect the mechanism 4 more easily by his/her hands than a small-sized mechanism, so the big-sized mechanism 4 is easier for the user to use than the smaller one.

The hook-shaped projection 5 of the connecting/disconnecting mechanism 4 is made smaller than the engaging opening 6 so as to make it easy for the user to handle the mechanism 4. Specifically, the area of the hook-shaped projection 5 is 131 $mm^2$ and the area of the engaging opening 6 is 297 $mm^2$, so that the reciprocal area ratio is set to be 1:2.7.

As shown in FIG. 1, the belt 3 is getting wider (the maximum width of 20 mm) as going toward a back portion 7 thereof which fits to the user's occipital region and getting narrower (the minimum width of 10 mm) around side portions 8 thereof which fits to user's temporal region. The belt 3 has the maximum width around the connected area with the connecting/disconnecting mechanism 4.

The belt 3 is made from silicone material and formed as a single-piece by hard portions 9 and a soft portion 10 (the degree of hardness is set to be about 40°). The connected areas of the belt 3 with the eye cup potion 1 are formed with the hard portions 9 (the degree of hardness is set to be about 80°). Only the connected areas with the eye cup potion 1 are formed with the hard portions 9 of the belt 3 and the other area of the belt 3 is formed with the soft portion 10.

Figure 8:
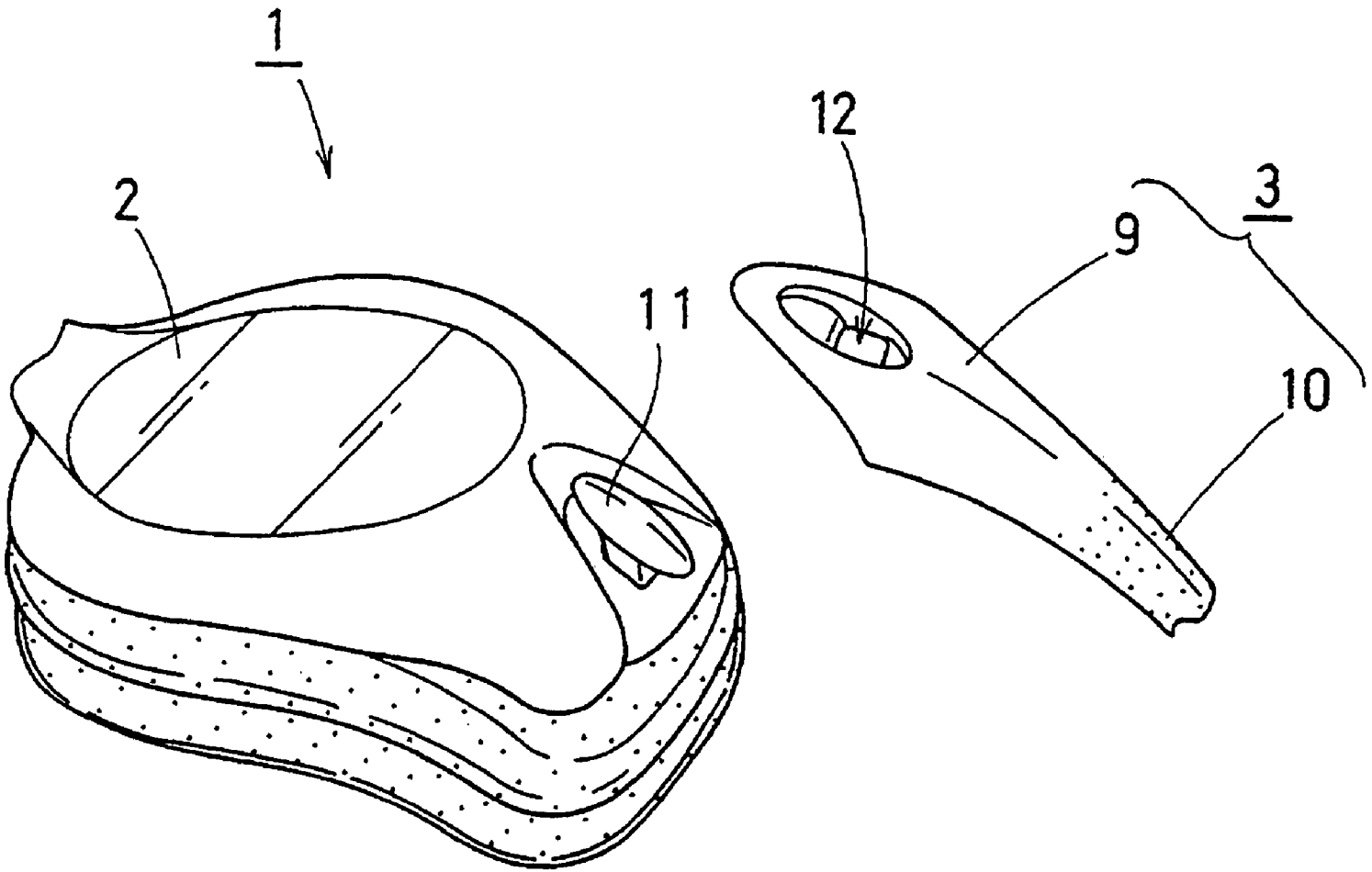
FIG. 8 is an enlarged perspective view of the swimming goggles shown in FIG. 1 showing the belt which is about to be connected to the eye cup portion
Figure 9:
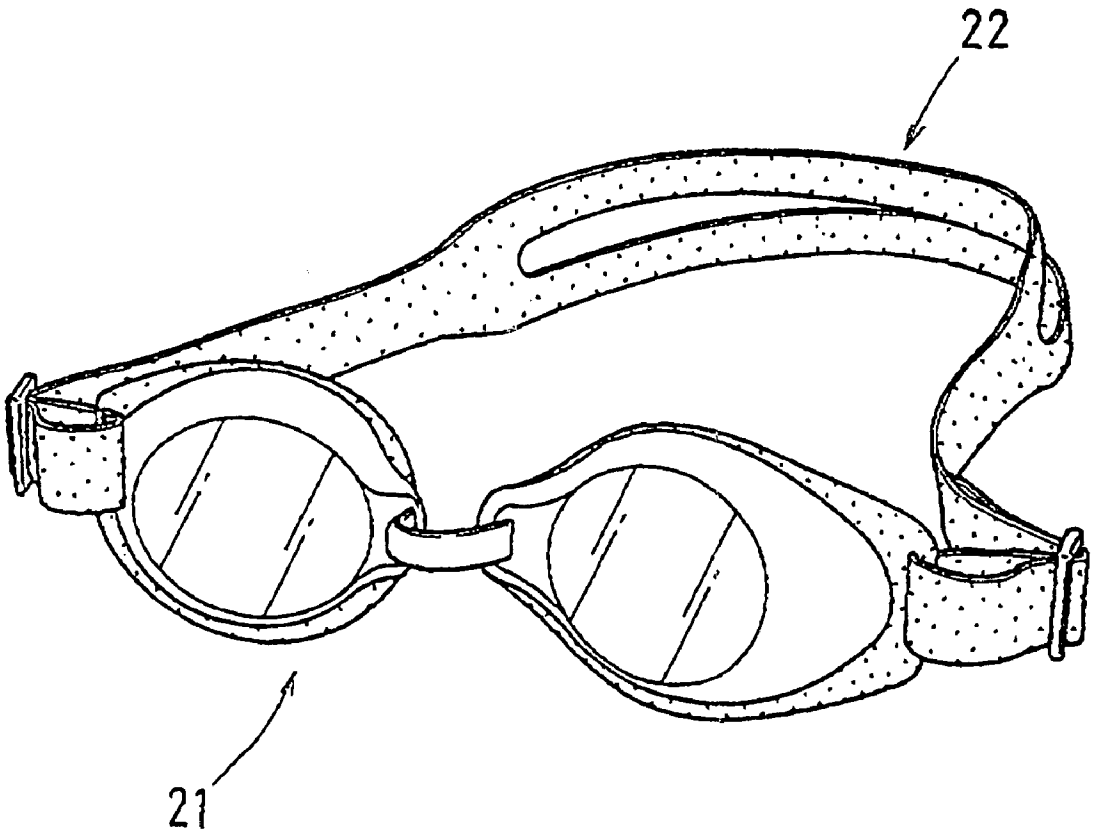
FIG.9 PRIOR ART
FIG. 9 is an entire perspective view of a conventional pair of swimming goggles.
Figure 10:
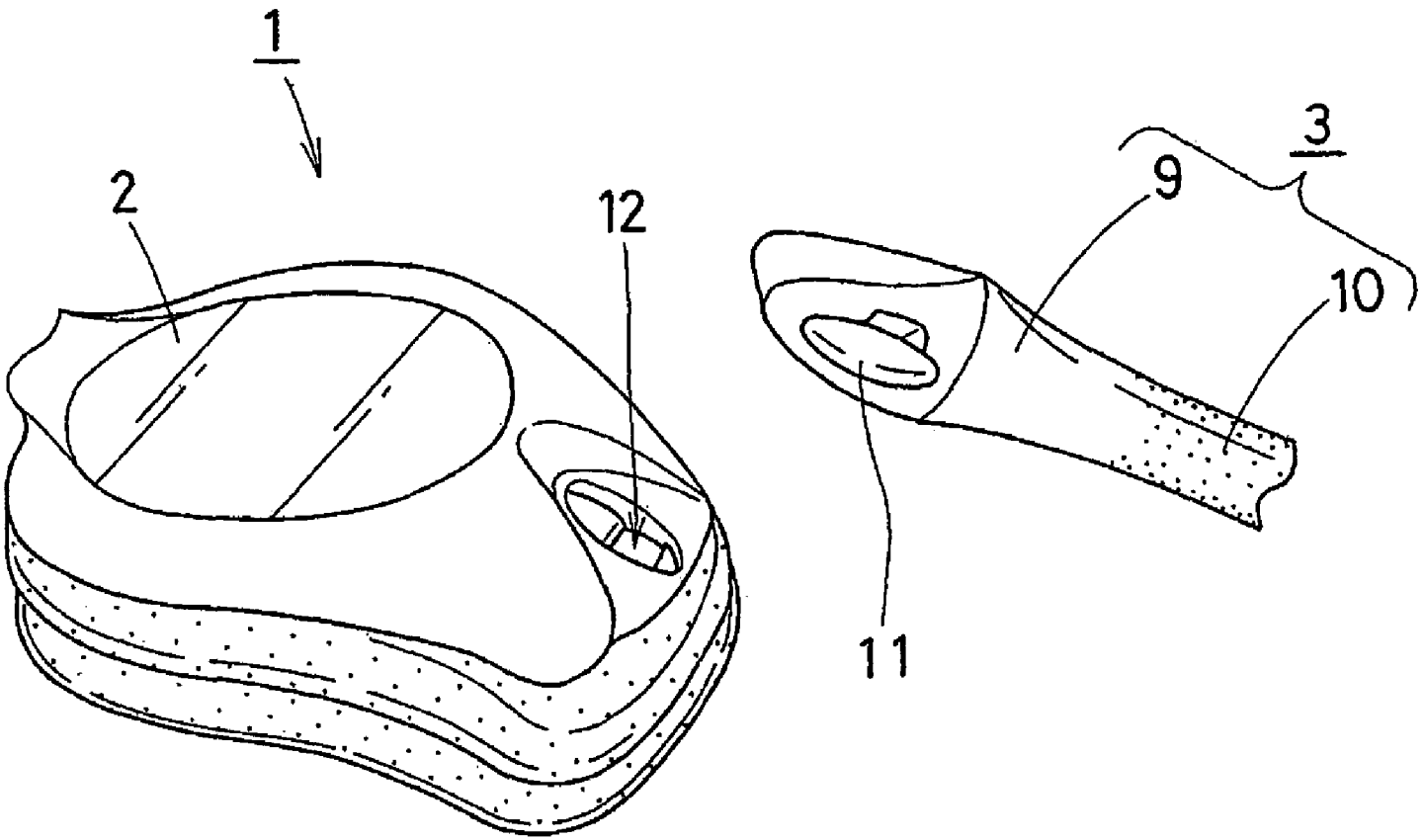
FIG. 10 is an enlarged perspective view of the goggles in shown in FIG. 1 showing an alternate connection for the belt to the eye cup portion.

As shown in FIG. 8, the eye cup portion 1 is provided with a T-shaped projection 11 on each of sides, and the hard portion 9 of each of edges of the belt 3 is provided with a hole 12 corresponding to the projection 11. The belt 3 can be connected to the eye cup portion 1 by inserting the projection 11 of the eye cup portion 1 into the hole 12 of the belt 3. The side areas of the eye cup portion 1 where the projections 11 are provided are also made from hard material (polycarbonate resin or cellulose propionate resin is used as the material).

Next, the pair of swimming goggles according to this embodiment which is in use will be explained below.

Figure 2:
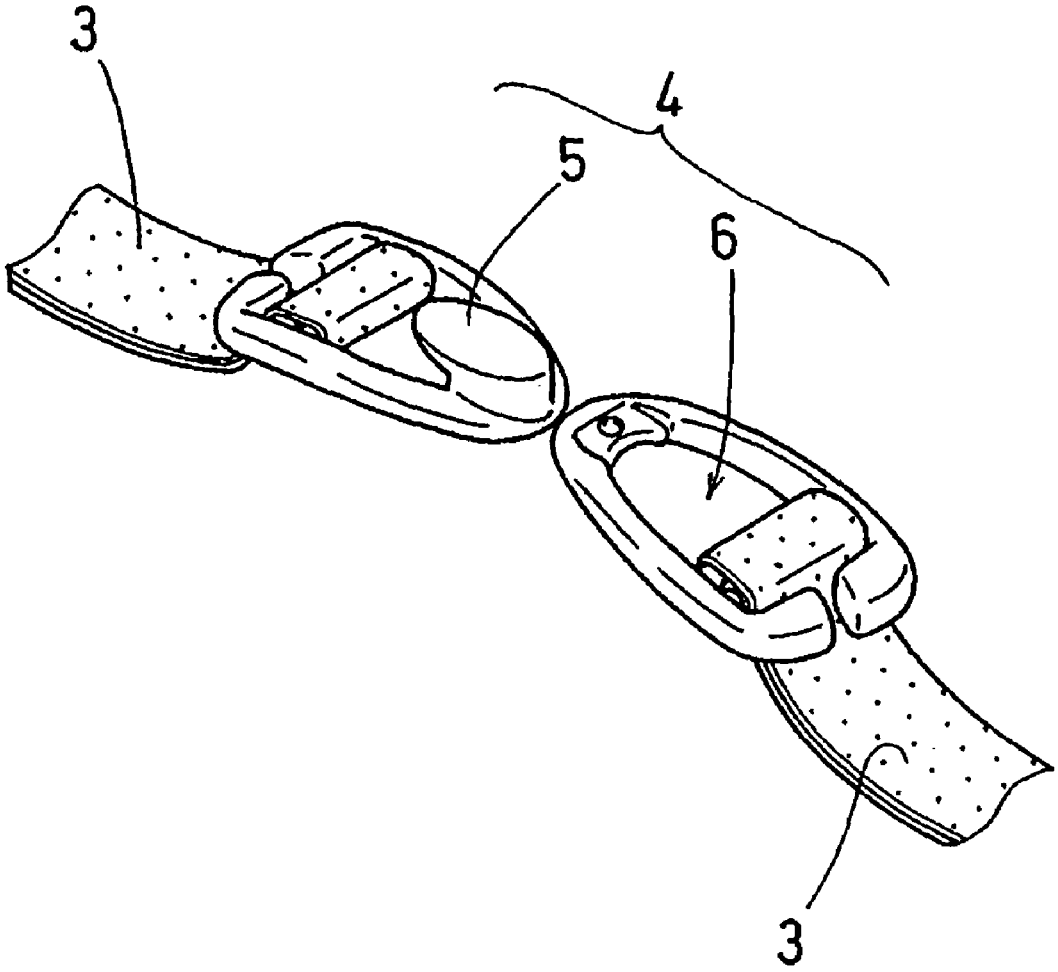
FIG. 2 is an enlarged perspective view of a hook-type connecting/disconnecting mechanism, which is in a disconnected state, of the swimming goggles shown in FIG. 1.
Figure 3:
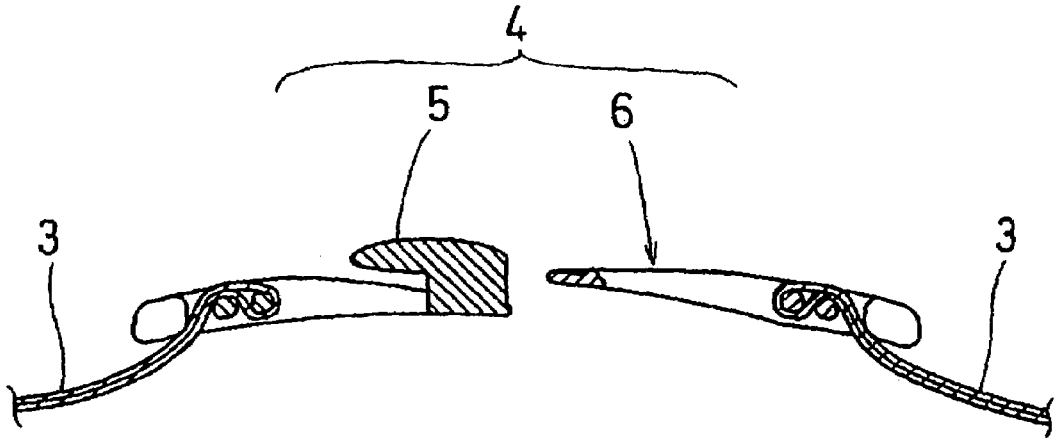
FIG. 3 is an enlarged sectional view of the hook-type connecting/disconnecting mechanism, which is in a disconnected state, of the swimming goggles shown in FIG. 1 which shows.
Figure 4:
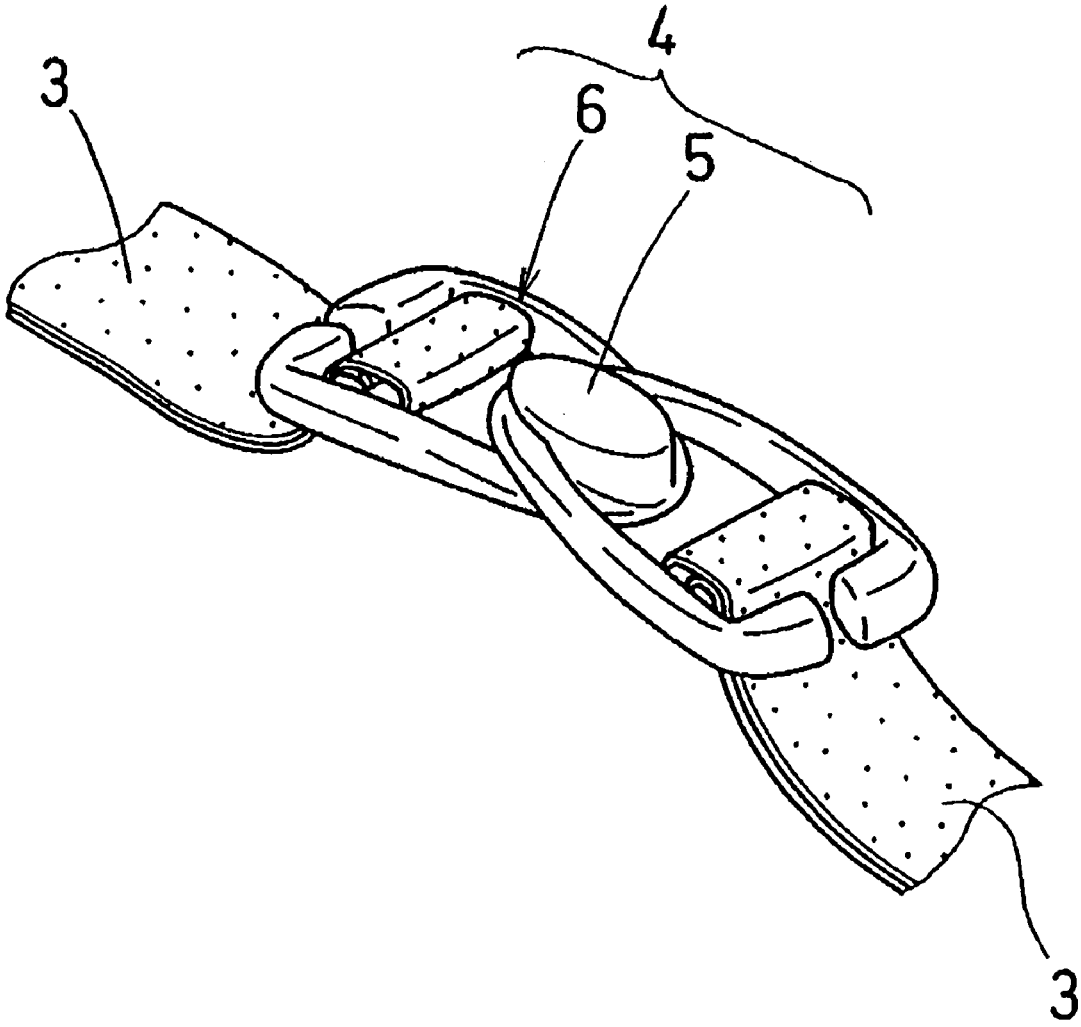
FIG. 4 is an enlarged perspective view of the hook-type connecting/disconnecting mechanism, which is in a connected state, of the swimming goggles shown in FIG. 1.
Figure 5:
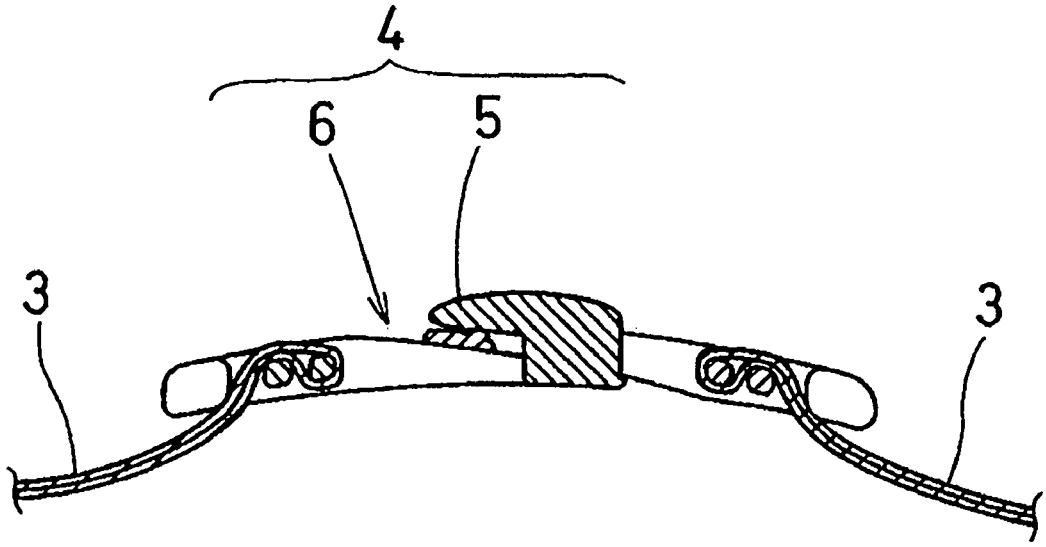
FIG. 5 is an enlarged sectional view of the hook-type connecting/disconnecting mechanism, which is in a connected state, of the swimming goggles shown in FIG. 1.
Figure 6:
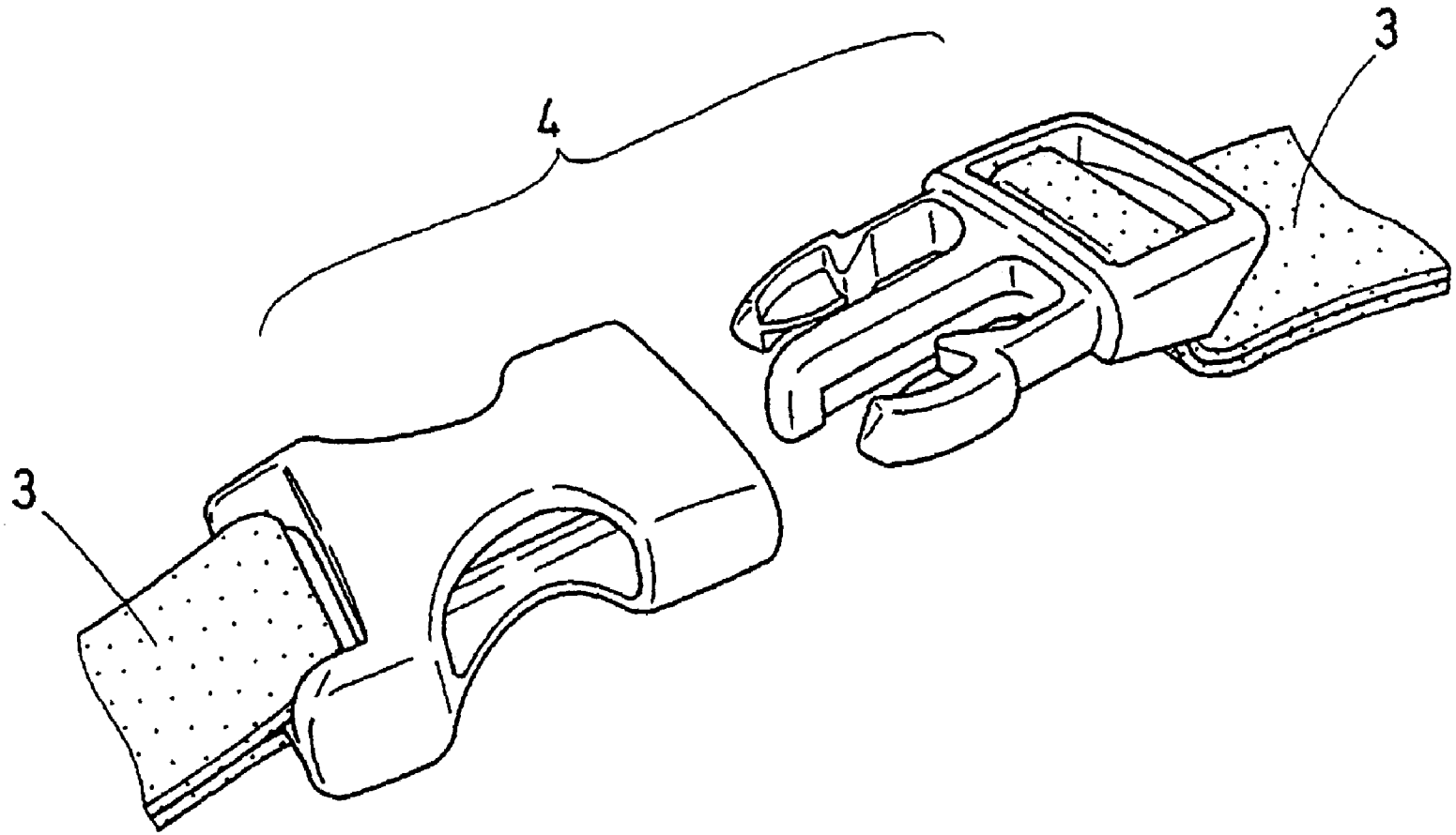
FIG. 6 is an enlarged perspective view of a buckle-type connecting/disconnecting mechanism, which is in a disconnected state, of another embodiment of the swimming goggles shown in FIG. 1.
Figure 7:
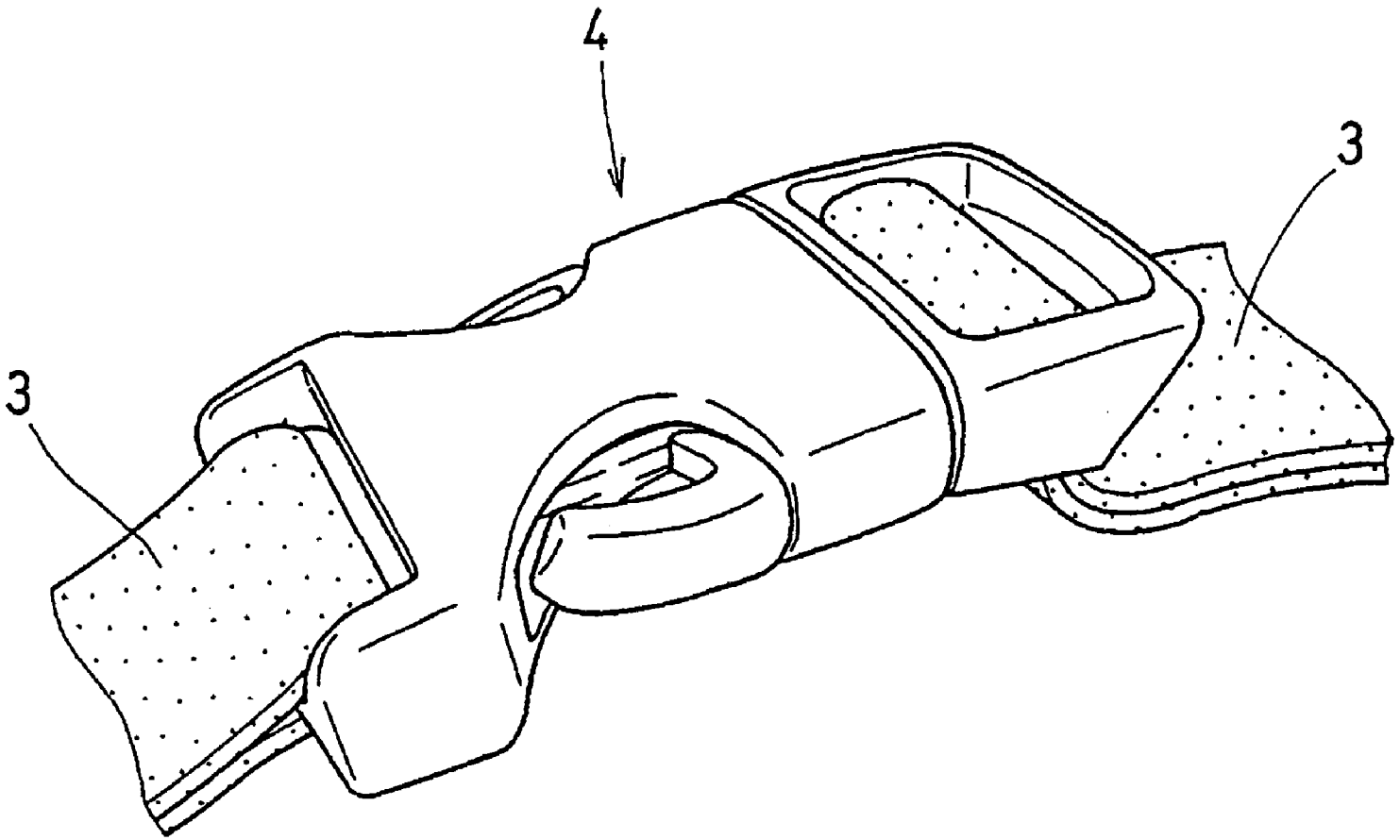
FIG. 7 is an enlarged perspective view of the buckle-type connecting/disconnecting mechanism, which is in a connected state, of another embodiment of the swimming goggles shown in FIG. 1.

In the pair of swimming goggles according to the present invention, since the connecting/disconnecting mechanism 4, which is used when a user puts the swimming goggles on and off his/her head, is provided to the belt 3 which is connected to the eye cup portion 1, the user can put the swimming goggles on and off his/her head by merely slightly pulling the belt to connect and disconnect the connecting/disconnecting mechanism (the connected state is shown in FIG. 4 and FIG. 5), (the disconnected state is shown in FIG. 2 and FIG. 3), and the user does not have to pull the belt 3 to extend it to such a length as to provide enough space for this/her head. And therefore, the pair of swimming goggles of the present invention has an advantage in that the user can put it on his/her head with less tousling his/her hair compared with conventional swimming goggles. In other words, when the user is putting the swimming goggles of this invention on and off his/her head, the user's hair is less likely to be tousled or pulled, and the swimming cap is less likely to be displaced or removed.

Since the back portion 7 which fits to the user's occipital region is made wider and the side portions 8 are made narrower, the pair of swimming goggles has other advantages in that the portion 7 with the wide width can increase a fitting comfortability, while the side portions 8 with the narrower width can stretch well.

Since the connected areas of the belt 3 with the eye cup portion 1, which are formed with the hard portion 9, are made from hard material, the pair of swimming goggles has further advantages in that the belt 3 can be firmly connected to the eye cup portion 1 and the connection of the belt 3 cannot to be released there from easily. On the other hand, the soft portion 10 of the belt 3 can fit to a user's head because of its elasticity. The pair of swimming goggles further has an advantage in that the eye cup portion 1 can be firmly connected with the hard portion 9 of the belt 3 since the side areas of the eye cup portion 1 where the projections 11 are provided are made from hard material.

The eye cup portion 1 is provided with the T-shaped projections 11 on its both sides and the hard portion 9 of the belt 3 is provided with the holes 12 corresponding to the projections 11 of the eye cup portion 1 so that the belt 3 and the eye cup portion 1 can be connected together by inserting the projections 11 of the eye cup portion 1 into the corresponding holes 12 of the belt 3. Thus, the pair of swimming goggles still further has an advantage in that the belt 3 can suitably be connected with the eye cup portion 1.

As described above, the pair of swimming goggles of this invention is easy to put on and off the head even for women with long hair, old people and children. The pair of swimming goggles can reduce any difficulties at the time of putting it on and off the head, can achieve the firm connection between the belt 3 and the eye cup portion I and can give the user a good comfortable fitting.

Since the present invention has such structures as described above and a user does not have to pull the belt to extend it to such a length as to provide enough space around his/her head, the present invention can provide a pair of swimming goggles which can be put on the head with less tousling the user's hair compared with conventional swimming goggles and a belt for the pair of swimming goggles as well.

The invention claimed is:

1. A pair of swimming goggles comprising:

two eye cup portions for protecting eyes of a user;

a pair of belts wherein each of said pair of belts has first and second ends and said first end of each of said pair of belts is connected to an end of one of the two eye cup portions;

a connecting/disconnecting mechanism provided on said second end of the belts for connecting and disconnecting the second ends of each of said belts together;

a fastening mechanism provided between said first end of each of said belts and one end of said eye cup portions; and wherein each belt is integrally formed with a hard portion at said first end and a remainder of said belt is formed with a soft portion and said fastening mechanism at said first end of the belt is formed from the hard portion without a folded back portion of said belt; and said connecting/disconnecting mechanism further includes means for adjusting a length of the belt connected to the connecting/disconnecting mechanism.

2. The pair of swimming goggles according to claim 1, wherein a back portion of the pair of belts which fits to the user's occipital region is made wider and side portions of the belt which fit to the user's temporal region are made narrower.

3. The pair of swimming goggles according to claim 1, wherein said fastening mechanism comprises a single projection on said ends of said two eye cup portions, and a single hole provided in the first end of said belts corresponding to the single projections so that the first ends of the belts and the ends of the two eye cup portions are fastened together by inserting the single projections of the two eye cup portions into the corresponding single holes of the first ends of the belts.

4. The pair of swimming goggles according to claim 1, wherein said fastening mechanism comprises the ends of the two eye cup portions provided with single holes, and the first ends of the belts provided with single projections corresponding to the single holes so that the first ends of the belts and the ends of the two eye cup portions are fastened together by inserting the single projections of the first ends of the belts into the corresponding single holes of the two eye cup portions.

5. The pair of swimming goggles according to claim 2, wherein said fastening mechanism comprises a single projection on said ends of said two eye cup portions, and a single hole provided in the first end of said belts corresponding to the single projections so that the first ends of the belts and the ends of the two_eye cup portions are fastened together by inserting the single projections of the two eye cup portions into the corresponding single holes of the first ends of the belts.

6. The pair of swimming goggles according to claim 2, wherein said fastening mechanism comprises the ends of the two eye cup portions provided with single holes, and the first ends of the belts provided with single projections corresponding to the single holes so that the first ends of the belts and the ends of the two eye cup portions are fastened together by inserting the single projections of the first ends of the belts into the corresponding single holes.

7. The pair of swimming goggles according to claim 1, wherein the connecting/disconnecting mechanism is a one-touch type selected from the group consisting of a buckle-type or a hook-type.

8. The pair of swimming goggles according to claim 1, wherein said hard portion and said soft portion of said belt are respectively made from a same material but having different hardnesses.

9. The pair of swimming goggles according to claim 1, wherein the belt has a hard portion made from hard material and a soft portion made from soft material and said fastening mechanism at said first end of the belt with the eye cup portion is formed with the hard portion.

10. The pair of swimming goggles according to claim 1, wherein the entire length of the pair of belts is predetermined by adjusting a length of each of the pair of belts between the connecting/disconnecting mechanism and the two eyecup portions.

11. A pair of goggles comprising:

at least one eye cup portion for protecting the eyes of a user;

a pair of belts wherein each said pair of belts has first and second ends and said first end of each of said pair of belts is connected to ends of said at least one eye cup portion;

a connecting/disconnecting mechanism provided on said second end of the belts for connecting and disconnecting the second ends of each of said belts together;

a fastening mechanism provided between said first end of each of said belts and each end of said at least one eye cup portion; and wherein each belt is integrally formed with a hard portion at said first end and a remainder of said belt is formed with a soft portion, and said fastening mechanism at said first end of the belt is formed from the hard portion without a folded back portion of said belt; and said connecting/disconnecting mechanism further includes means for adjusting a length of the belt connected to the connecting/disconnecting mechanism.

12. The goggles according to claim 11 wherein said fastening mechanism comprises a single projection on said ends of said at least one eye cup portion and a single hole provided in the first end of said belts corresponding to the single projection so that the first end of the belts and the ends of said at least one eye cup portion are fastened together by inserting the single projection of the at least one eye cup portion into corresponding single hole of the first ends of the belts.

13. The pair of goggles according to claim 11 wherein said fastening mechanism comprises ends of said at least one eye cup portion provided with single holes, and first ends of the belts provided with projections corresponding to the single holes so that the first ends of the belts and the ends of the at least one eye cup portion are fastened together by inserting the single projections into the corresponding single holes of the at least one eye cup portion.

* * * * *